United States Patent [19]

Stempski

[11] Patent Number: 4,458,432

[45] Date of Patent: Jul. 10, 1984

[54] ADJUSTABLE WEIGHT ATHLETIC TRAINING/RACING SHOE

[76] Inventor: Frank Stempski, 1454 Fields Dr., San Jose, Calif. 95129

[21] Appl. No.: 395,365

[22] Filed: Jul. 6, 1982

[51] Int. Cl.[3] ..... A43B 5/00; A43B 23/00

[52] U.S. Cl. ..... 36/132; 36/136

[58] Field of Search ..... 36/132, 136

[56] References Cited

U.S. PATENT DOCUMENTS

| | | | |
|---|---|---|---|
| 2,712,700 | 7/1955 | Solomon | 36/136 |
| 3,114,982 | 12/1963 | McGowan | 36/132 |
| 3,406,968 | 10/1968 | Mason | 36/132 |

*Primary Examiner*—Patrick D. Lawson

*Attorney, Agent, or Firm*—David B. Harrison

[57] ABSTRACT

An improved runner's athletic shoe for training and/or racing is disclosed. The improved shoe comprises a preformed, cushioned unitary sole-heel structure and a lightweight, laced vamp upper structure extending from the base structure. The improvement comprises a weight pocket at the outside of a toe region of the upper structure, for receiving removeable weights therein at a maximum moment arm relative to rotation of the runner's ankle. Further improvements in heel and side pockets for additional weights are also disclosed.

6 Claims, 3 Drawing Figures

ADJUSTABLE WEIGHT ATHLETIC TRAINING/RACING SHOE

BACKGROUND OF THE INVENTION

The present invention relates to an athletic shoe suitable for training and racing purposes. More particularly the present invention relates to an adjustable weight athletic training/racing shoe which includes means for adding weight to the shoe for training purposes at the toe, heel, and sides thereof.

The addition of weight to strategic areas during training develops individual muscles and muscle groups in the foot, ankle and leg areas. Different muscle groups are developed with each different strategic weight added. Conventional ankle weights are known for use in training. One of the drawbacks of ankle weights is that the length of the moment arm about (or around) the ankle pivot is zero. Thus, muscle groups associated with rotating the foot are not developed with the use of ankle weights.

One prior art approach to providing removable weight for athletic training and racing shoes are disclosed in the McGowan U.S. Pat. No. 3,114,982. Therein, a removable weight assembly was disclosed for mounting on an athletic shoe by means of snap fastening. The McGowan approach had several drawbacks. First, McGowan's weights were not located at the maximal fulcrum points of the ankle to foot rotation and therefore did not permit maximum muscle resistance with minimum weight applied. Second, McGowan's weights were located over the foot structure and in the plane of rotation which would cause callusness and eventual injury to that area of the foot during repeated exercising. Third, McGowan's weights were rigid which added to the injurious effects just mentioned. Fourth, McGowan's removable weight attachment for an exercise shoe with a "sole for inner and outer sidewalls" made no mention of arch support, heel counter, or heel and forefoot cushioning which would be required to compensate for added weight in a walk-run-jog exercise routine.

Other prior art examples of footwear provided with pockets therein include U.S. Pat. No. 1,100,758 to McAuslin, U.S. Pat. No. 2,742,715 to Meltzer, U.S. Pat. No. 3,018,570 to Bliese and U.S. Pat. No. 2,662,677 to Perry. A device for adding a weight coextensive with an entire shoe sole and heel structure is described in U.S. Pat. No. 1,990,970 to Wood. The drawback of the Wood shoe was that the weight was added to the entire shoe structure, rather than being concentrated at desirable moment arms of rotation.

One object of the present invention is to provide an athletic running/jogging shoe which includes weight pockets for receiving weights located at the toe and heel of the shoe whereby the maximal fulcrum points of the ankle-foot muscle group receive primary stress during exercise.

Another object of the present invention is to provide flexible lead-tape strip weights positioned in the shoe around the extremities of the foot whereby injury from repeated pounding or striking of the foot structure by non-flexible weights located on the foot or in the plane of the foot's movement during exercise is eliminated.

One more object of the present invention is to provide an athletic running/jogging shoe to which weights are attached by plastic mesh-hook fasteners whereby the weights may be moved by hand.

Yet another object of the present invention is to provide a combinational weighted training shoe and lightweight racing shoe which includes a foot plant cushioning and support provided by the arch support, heel counter and foam rubber inner soles, and adjustable/-removable weight pockets.

One more object of the present invention is to provide a running/jogging shoe which combines additional removable weights together with cushioning and foot support.

Still one more object of the present invention is to provide an athletic running/jogging shoe which is improved by providing pockets containing flexible weights located at the toe and heel areas to give maximal stress to the ankle-foot muscle group while being located outside of the extremities of the foot to eliminate the possibility of injury caused by weights located on the foot during exercise.

Yet another object of the present invention is to provide an athletic running/jogging shoe wherein the weights are enclosed in a separate pocket structure which may be attached to the shoe by plastic mesh-hook fasteners to enable weight to be readily added or removed.

DETAILED DESCRIPTION OF A PREFERRED EMBODIMENT

Figure 1:
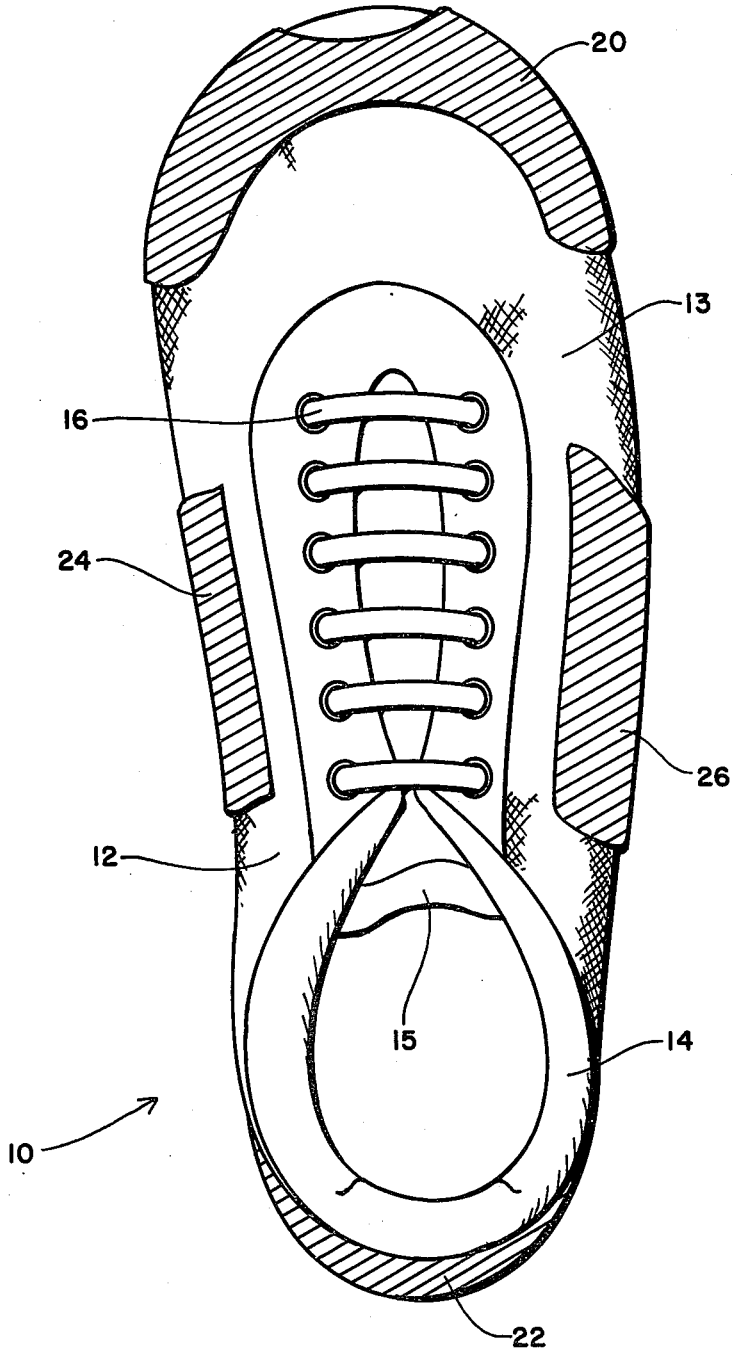
FIG. 1 is a top plan view of an athletic running shoe for racing and training which is constructed in accordance with the present invention.
Figure 2:
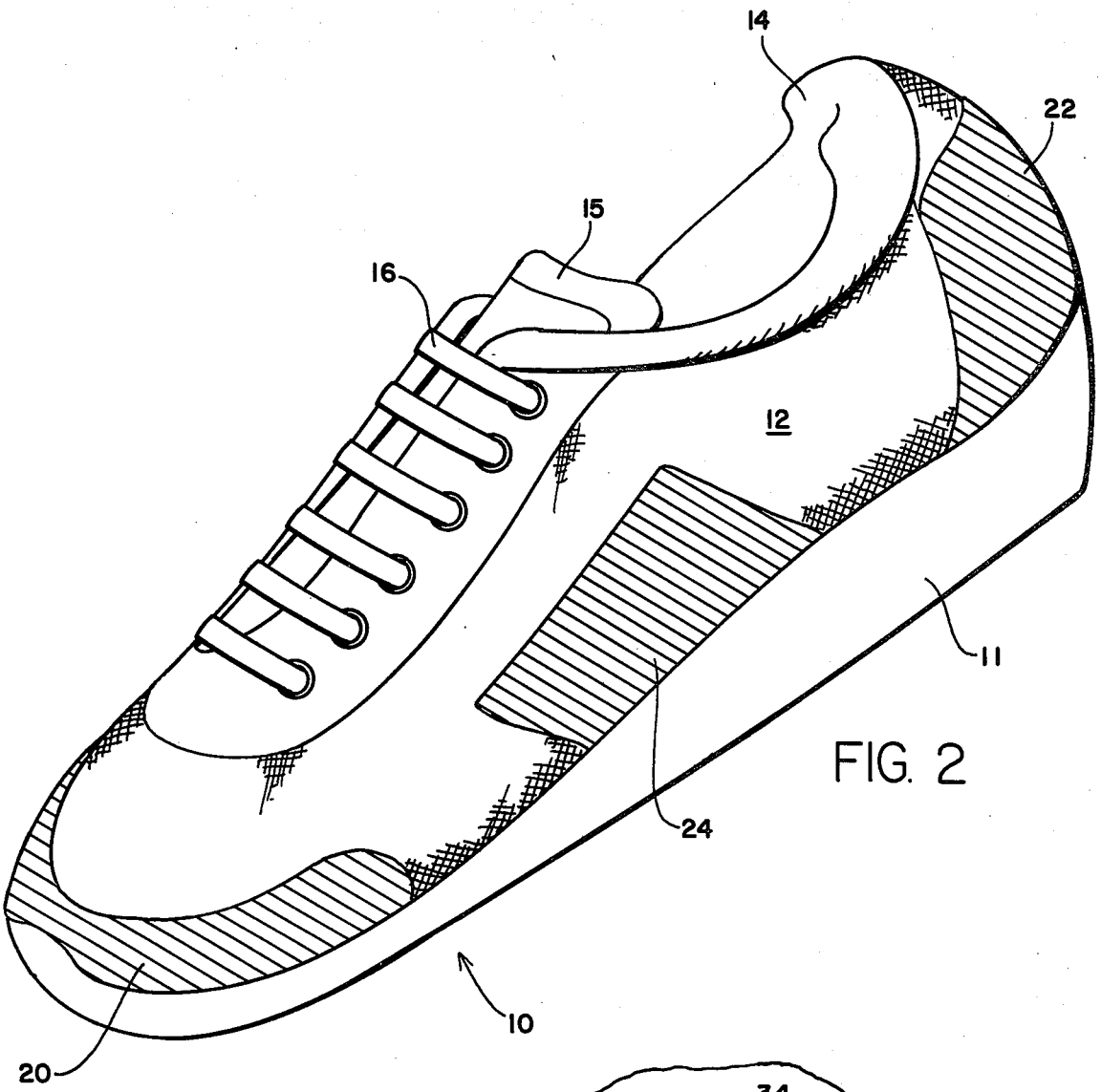
FIG. 2 is an orthogonal side view of the shoe illustrated in FIG. 1.

With reference to the figures, an athletic shoe 10 suitable for racing and training is shown as including a unitary sole-heel base structure 11 made of molded foam rubber. An inner sidewall and vamp upper 12, and an outer sidewall and vamp upper 13 form the top side of the shoe and extend upwardly from the base structure 11. An ankle cushion 14 is provided to cushion the ankle at the top of the shoe 10. A tongue 15 protects the top of the foot from chafing from conventional lacing 16.

The shoe 10 includes a toe pocket 20, a heel pocket 22, an inner side pocket 24, and an outer side pocket 26.

Figure 3:
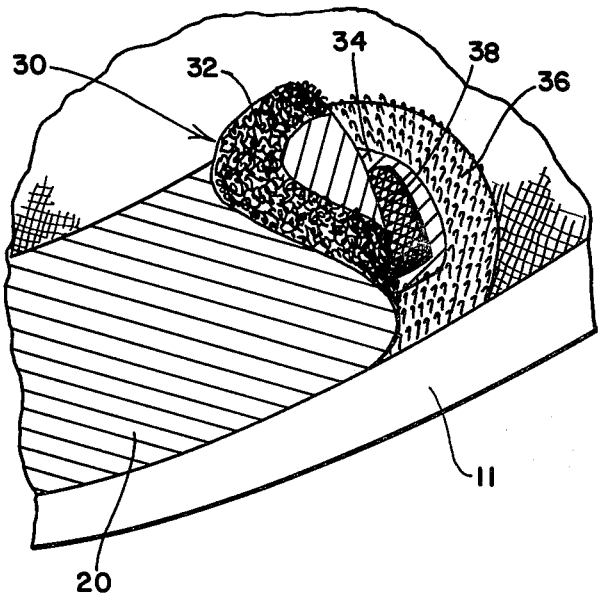
FIG. 3 is an enlarged sideview of a segment of the toe portion of the shoe of FIG. 1 showing the weight pocket partially opened.

With reference to FIG. 3, the toe pocket 20 includes an outer flap 30. Velcro loop-hook material 32 is fixed about the inside periphery of the outer flap 30, thereby defining an interior pocket 34. A Velcro strip 36 is aligned to engage the Velcro strip 32. A flexible lead toe weight 38 is shown inserted in the interior pocket 34. The lead weight may be directly inserted into the pocket, or it may be included inside of the outer flap 30, in which case the outer flap 30 would be a totally detachable weight, easily removable from the shoe 10. The construction of the heel pocket, inner side pocket, and outer side pocket is as shown for the toe pocket in FIG. 3. The weights, such as the weights 38 in the toe pocket, can be changed gradually in each pocket according to changing periods in the training phase. At race time, the weight can be completely removed from minimum weight condition of the shoe 10. Placing the weights, such as the weight 38, in the specific foot areas has distinct advantages over conventional ankle weights. Weights in the toe pockets provide resistance to those muscles associated with lifting and lowering the forward portion of the foot. During running, the toe weights rotate with a moment arm centered at the point of rotation of the foot about the ankle. The length of the moment arm is the distance from the effective center of the mass of the distributed weight to this point of rotation. For ankle weights, the length of this moment arm is zero. Thus, the muscle groups associated with rotating the foot are not developed with the use of ankle weights, whereas they are with the present invention.

Normally, the muscle groups associated with rotating the toe in a downward direction are developed in the act of lifting the body weight off the ground while raising the heel of the foot during running. No commensurate resistance is given to the act of rotating the toe of the foot upward. Therefore, the muscles associated with this upward rotation are not developed in a proper manner. Toe weights, such as the flexible lead tape weight 38, provide a resistance heretofore never available for use in a running shoe. The development of muscles associated with upward rotation not only provide the strengthening of these muscle groups, but also provide the balance and the muscle development of the runner. This makes the runner less susceptible to injury.

Weight may be selected to be placed in the toe pocket 20, the heel pocket 22, the inner side pocket 24, or the outer side pocket 26 in accordance with the need to provide resistance to the muscle groups associated with the lifting, lowering and rotating of the specific areas of the foot most effected by the particular weight added. Each pocket location has a moment arm the length of which is the distance from the effective center of the mass of the weight to the pivotable point of ankle rotation. The lifting, twisting and rotating occurs with each pronation or supination of the foot as it strikes the ground during the act of jogging or running. Typically, the shoe 10 will have a basic weight of 5 and ½ to 6 and ½ ounces, for example, in a man's size 9 shoe. The same shoe may be increased in weight to 10 to 12 ounces for training purposes by the addition of weight to the pockets 20, 22, 24 and 26. The most valuable facet of the adjustable weight shoe 10 of the present invention is its ability to maintain the same foot support, the same cushioning or shock absorption and the same foot plant during a race with the weights removed as that provided during training when the weights are in place. This feature eliminates the need to change shoes or to go through an adjustment period. It also saves the expense of buying an extra pair of shoes for racing.

To those skilled in the art to which the present invention pertains many widely varying embodiments and modifications will be readily suggested from the foregoing description. Nothing in this description of a preferred embodiment should be construed as limiting of the scope of the present invention.

I claim:

1. In a runner's athletic shoe having a preformed, cushioned unitary sole-heel base structure, and a lightweight, laced vamp upper structure extending from the base structure, the improvement comprising a weight pocket at the outside of a toe region of said upper structure, for receiving removeable weights therein at a generally maximum moment arm relative to rotation of the runner's ankle, said weights being located substantially entirely outside the plane of movement of the runner's feet during running and jogging exercise.

2. The improved runner's athletic shoe set forth in claim 1 further comprising a heel pocket for receiving removable weights therein.

3. The improved runners athletic shoe set forth in claim 1 further comprising at least one side pocket for receiving removable weights therein.

4. The improved runner's athletic shoe as set forth in claim 1 further comprising a heel pocket, an inner side pocket, and an outer side pocket located on the side portions of the upper structure of said shoe for receiving removable weights therein.

5. In a runner's athletic shoe having a preformed, cushioned unitary sole-heel base structure, and a lightweight, laced vamp upper structure extending from the base structure, the improvement comprising a weight pocket at the outside of a toe region of said upper structure and having a removable flap for receiving removable weights therein at a generally maximum moment arm relative to rotation of the runner's ankle, said flap being completely detachable from said shoe to effect removal of the weights therefrom.

6. In a runner's athletic shoe having a preformed, cushioned unitary sole-heel base structure, and a lightweight, laced vamp upper structure extending from the base structure, the improvement comprising a weight pocket at the outside of a toe region of said upper structure, for receiving removable weights therein at a generally maximum moment arm relative to rotation of the runner's ankle, and further including plastic mesh-hook fasteners exposed on said upper structure at said pocket to a removeable attachment of the flap of said pocket to said shoe to enable attachment and removal of said weights.

* * * * *